US005483928A

United States Patent [19]

Mahlberg et al.

[11] Patent Number: 5,483,928

[45] Date of Patent: Jan. 16, 1996

[54] LIQUID COOLED INTERNAL COMBUSTION ENGINE

[75] Inventors: Hans-Peter Mahlberg, Rosrath; Heinz W. Fuchs, Remscheld; Reinhard Rechberg, St. Augustin; Lothar Bauer, Cologne; Werner Lemme, Rostrath; Wolfgang Strusch, Cologne; Tai Tedsen, Orfoan Hahn; Herbert Schleiermacher, Bruhl; Jürgen Wahnschaffe, Bergisch Gladbach, all of Germany

[73] Assignee: Klockner-Humboldt-Duetz AG, Koln-Porz, Germany

[21] Appl. No.: 273,475

[22] Filed: Jul. 11, 1994

[30] Foreign Application Priority Data

Jul. 27, 1993 [DE] Germany ..... 43 25 141.2

[51] Int. Cl.[6] ..... F07P 3/00

[52] U.S. Cl. ..... 123/41.42; 123/196 AB

[58] Field of Search ..... 123/41.33, 41.42, 123/41.74, 196 AB

[56] References Cited

U.S. PATENT DOCUMENTS

| | | | |
|---|---|---|---|
| 4,175,503 | 11/1979 | Ernest | 123/41.74 |
| 4,708,095 | 11/1987 | Luterek | 123/41.42 |
| 4,926,800 | 5/1990 | Valev | 123/41.42 |

FOREIGN PATENT DOCUMENTS 3509095 10/1985 Germany .

*Primary Examiner*—Noah P. Kamen

*Attorney, Agent, or Firm*—Hardaway Law Firm; Charles L. Schwab

[57] ABSTRACT

An internal combustion engine which each cylinder has a cylinder cooling space and each cylinder head has a head cooling space, the individual cylinder cooling spaces being connected in series, the individual head cooling spaces being connected in series and the cylinder cooling spaces, as a group, cooling spaces, as a group, being connected in series. The engine includes a lubrication oil system which supplies cooling oil to the cylinder and head cooling spaces as well as supplying lubricating oil to lubricate other components such as the bearings for the crankshaft, the crankshaft and the piston connecting the rods.

12 Claims, 3 Drawing Sheets

LIQUID COOLED INTERNAL COMBUSTION ENGINE

TECHNICAL FIELD

This invention relates to an internal combustion engine and more particularly to a cooling system for the cylinder and cylinder heads using oil as the coolant.

BACKGROUND OF THE INVENTION

German patent document DE-OS 35 09 095 discloses an oil-cooled reciprocating internal combustion engine that has cooling oil spaces, a lubrication system and an oil pump which have a series fluid flow relationship. In detail, the oil system of this reciprocating internal combustion engine is designed in a rather complicated and expensive way.

OBJECTS AND SUMMARY OF THE INVENTION

It is an object of the invention to simplify the oil circuit of an internal combustion engine, and by this means to lower the cost of the engine.

The foregoing object is achieved by virtue of the fact that each cylinder of the internal combustion engine in accordance with the invention has a cylinder cooling space and each cylinder head has a head cooling space, the individual cylinder cooling spaces and the individual head cooling spaces being connected among themselves in series and the cylinder cooling spaces as well as the head cooling spaces, as a whole, being connected in series. By this arrangement, the cooling oil is compulsorily led through all cooling oil spaces of the internal combustion engine without requiring separate cooling oil distribution lines. Furthermore, the heat capacity of the cooling oil is maximally utilized by means of the sequential connection of all cooling spaces.

It is advantageous that the cylinder cooling space of one end cylinder is in flow connection to the oil pump via an inlet line and the cylinder cooling space of the opposite end cylinder is in flow connection to a drain line, and that a throttle is arranged in the drain line, ahead of which throttle a supply line to the head cooling spaces branches off and behind which throttle a return flow line from the head cooling spaces opens into the drain line. The throttle acts in such a way that a portion of the cooling oil, after leaving the cylinder cooling spaces, flows compulsorily into the head cooling spaces, while a portion of the cooling oil flows directly through the throttle.

By means of an advantageous development of the invention, in which a head cooling space remote from the flywheel is in flow connection to the end cylinder cooling space at least via an opening in the cylinder head gasket, a low-cost cooling oil guidance is achieved because the openings are stamped at the same time that the cylinder head gasket is fabricated.

It is advantageous that each individual head cooling space is in fluid communication with the return flow line, each via a web hole and a connecting hole branching therefrom. In this fashion, the thermally severely loaded portions of the cylinder head between the breathing valves are intensively cooled.

Also advantageous is that the flow direction of the head cooling spaces is opposite to the flow direction of the cylinder cooling spaces and of the return flow line. By this means the supply of cooling oil and its return takes place at different ends of the cylinder block, by which means there results a simple, easily understood cooling oil guidance.

The constructional expense for lubrication of the rocker arm bearings is minimized by virtue of their being in fluid communication with the return flow line for the cooling oil which passes very close to the rocker arm bearings.

It is advantageous that an air/oil heat exchanger is arranged in the oil circuit between the cooling oil spaces and the lubrication system. In this way, the lubrication system is supplied with relatively cool and effective lubricating oil.

It is advantageous that a thermostat is arranged in the oil circuit between the cooling oil spaces and the air/oil heat exchanger, which thermostat controls flow in a heat exchanger inlet line and a heat exchanger bypass line. In this way, rapid warm up of the internal combustion engine is achieved, which has a favorable effect on fuel consumption and pollutant emission.

It is also advantageous that an oil filter having a contaminated oil space and a clean oil space is arranged in the oil circuit, the contaminated oil space being in fluid communication with the heat exchanger bypass line, and to the air/oil heat exchanger via a heat exchanger return flow line, and the clean oil space is in fluid communication with the lubrication system. In this fashion, cooled or not yet heated oil always reaches the oil filter, so that the lubrication system is supplied with cooled and filtered oil. This is an important prerequisite for long service life of the internal combustion engine.

By means of an advantageous development of the invention, in which at least one piston spray nozzle is provided per cylinder, the piston spray nozzles being in flow connection to the lubrication system, it is achieved that the pistons are intensively cooled and the piston running surface is lubricated with clean oil.

Also advantageous is that a discharge line branches off the heat exchanger bypass line, ahead of the oil filter in the flow direction, which discharge line opens into an oil pan, and that a pressure regulating valve opening toward the oil pan is arranged in the discharge line. By this means, the oil pressure required for proper lubrication is insured.

It is also advantageous that a heating supply line branches off the discharge line, down stream of the pressure control valve. Downstream of this branching, a heating oil return line connects to the discharge line, a heating oil pressure regulating valve opening toward the oil pan is arranged in the discharge line between connections of the heating oil supply and the heating oil return lines with the discharge line, and an anti-draining valve opening toward the discharge line is placed in the heating oil return line. Since the heating oil is withdrawn from the return oil stream, there is no adverse effect on oil flow for lubrication and cooling. The heating pressure regulating valve insures compulsory flow through the heating heat exchanger as soon as the latter is turned on. The anti-draining valve insures that the heating heat exchanger is always filled with oil and thus that an accurate monitoring of the oil level of the internal combustion engine is possible.

In a preferred embodiment of the invention, the sum of the opening pressures of pressure regulating valves (including the heating pressure regulating valve) is at least 3 bar and the opening pressure of the anti-draining valve is approximately 0.3 bar. In this way, the minimum required oil pressure is insured and running dry of the heat exchanger is positively prevented.

In development of the invention, before operating the internal combustion engine, a fusible body holding the thermostat housing spaced away from the wall is arranged between the thermostat housing and the wall on which the thermostat plunger shifting the thermostat housing against the force of a spring is braced. This insertion of a fusible body has the effect that, upon first operation of the engine, the valve body controlled by the thermostat is shifted by the same amount as the oil thermostat. In this way, however, the heat exchanger inlet line is at least partially open upon first operation of the engine. This has the advantage that, upon first filling of the internal combustion engine with oil, the entire cooling and lubrication oil system can be filled with the prescribed fill quantity. This was not possible in the previous version, because in the cold condition the oil thermostat blocked the heat exchanger inlet line from the rest of the oil circuit and thus prevented inflow of oil into this heat exchanger inlet line. For this reason, after the initial warming up of the internal combustion engine, oil again had to be topped off (added) and the prescribed quantity of lubricating oil had to be adjusted. This was the case after approximately 8 to 15 minutes, so that the first filling with oil lasted a corresponding length of time. By means of the arrangement of the fusible body in the oil thermostat, this filling time is reduced to approximately 2 minutes, and it is insured in every case that the internal combustion engine is filled with the prescribed quantity of oil and the formerly required topping off, which was forgotten under some circumstances, is obviated. The fusible body, moreover, is designed in such fashion that it melts after the first running of the internal combustion engine, upon warming up of the internal combustion engine, and thus permits the normal function of the oil thermostat. The fusible body is made from such a material that does not result in any impairment of the oil circuit of the internal combustion engine.

In development of the invention, the fusible body is a fusible ring. This design has the advantage that the thermostat housing rests with its full surface area against the fusible ring and canting is prevented.

In development of the invention, the fusible body is fabricated from a wax. Such a wax ring, after it has melted away, represents no impairment of the oil circuit.

BRIEF DESCRIPTION OF THE DRAWINGS

Further features of the invention can be seen from the drawings illustrating a preferred embodiment of the invention.

DETAILED DESCRIPTION

Figure 1:
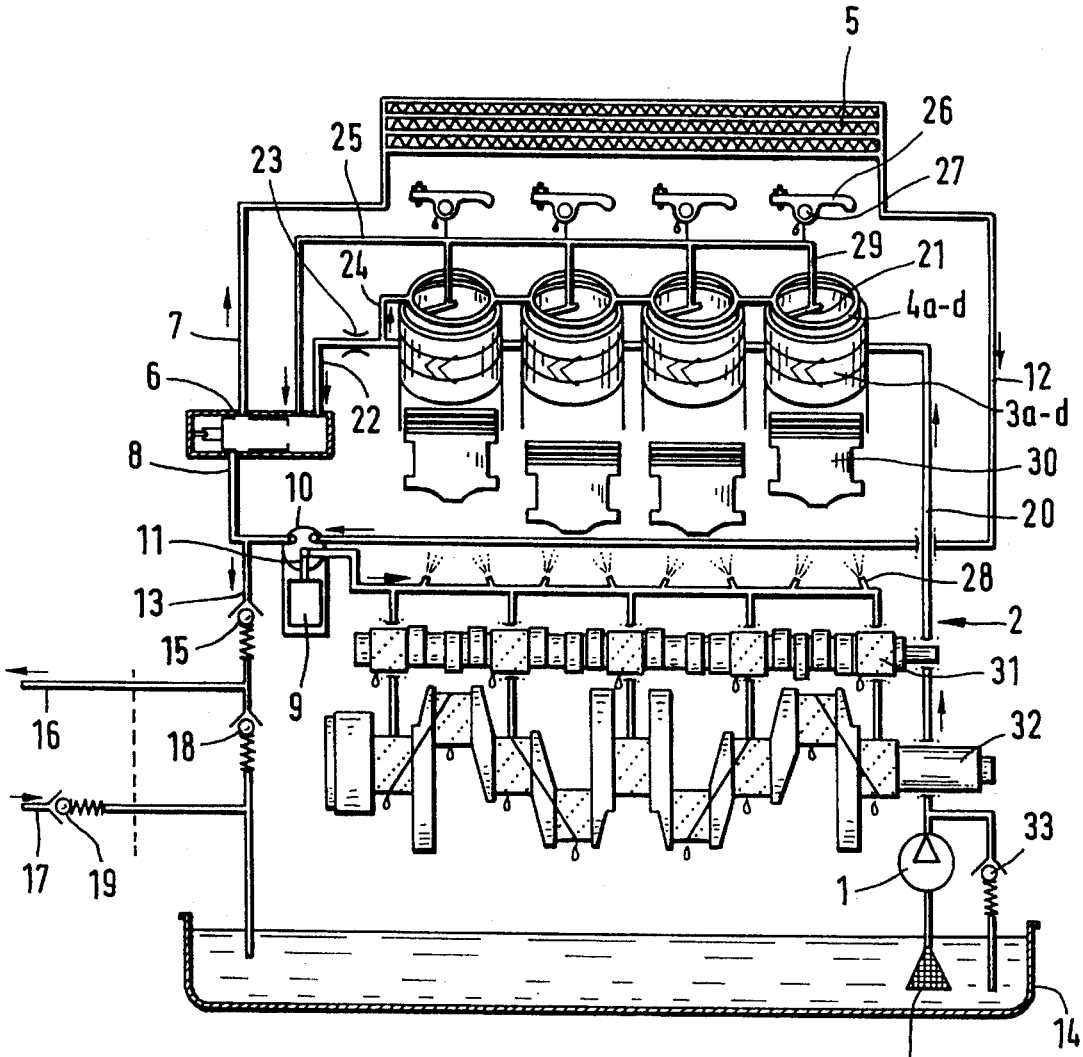
FIG. 1 schematically shows the oil circuitry of the internal combustion engine.

The oil from oil pan 14 is drawn in by oil pump 1 via strainer 34 and discharged into inlet line 20. In case of excessively high oil pressure, relief valve 33, allows oil to be bypassed back to the oil pan 14.

From inlet line 20, the oil passes into cylinder cooling spaces 3*a*, 3*b*, 3*c*, 3*d*, which are connected sequentially. From cylinder cooling space 3*d*, the oil flows into drain line 22, in which throttle 23 is arranged. Ahead of throttle 23 in the flow direction, supply line 24, leading into the sequentially connected head cooling spaces 4*a*, 4*b*, 4*c*, 4*d*, branches off drain line 22. Individual head cooling spaces 4*a* to 4*d* are connected, via a web hole 21 and a connecting hole 29, each to a return flow line 25, which together with drain line 22 conveys the oil into oil thermostat 6. The bearings 27 for the rocker arms 26 arranged in the cylinder head are lubricated by connections to the return flow line 25. The oil thermostat controls flow in the heat exchanger inlet line 7 and in the heat exchanger bypass line 8 in dependence on the oil temperature. By means of the heat exchanger inlet line 7, the oil flows to the air/oil heat exchanger 5 and further, via the heat exchanger return flow line 12, to the contaminated oil space 10 of the oil filter 9. In the case of cold oil, the oil passes via the heat exchanger bypass line 8 directly to the contaminated oil space 10.

After flowing through oil filter 9, the oil reaches clean oil space 11 and from there passes into the lubrication system 2. This includes distribution lines to the bearings of a camshaft 31 and of a crankshaft 32 as well as to piston spray oil nozzles 28 for pistons 30.

Branching off the heat exchanger bypass line 8 is a discharge line 13, which opens into the oil pan 14. A pressure regulating valve 15 opening toward oil pan 14 is arranged in discharge line 13. This valve serves to maintain a minimum pressure in the oil system. Downstream of the pressure regulating valve 15, a heating oil supply line 16 branches off from discharge line 13, which heating supply line leads to a heating heat exchanger, not illustrated. From the heat exchanger, the oil passes via heating oil return line 17 and anti-draining valve 19, opening in the direction of the oil pan, back to the discharge line 13 and, via the latter, into the oil pan 14. In the discharge line 13, between the heating oil supply line 16 and heating return line 17, there is a heating oil pressure valve 18 opening toward the oil pan 14. When the heating heat exchanger is turned on, the heating oil pressure valve insures compulsory flow through the heat exchanger. When the heating heat exchanger is turned off, the pressurizing valve 15 and the heating pressure valve 18, connected in sequence, insure the maximum oil pressure in the oil circuit. Anti-draining valve 19 prevents the heating heat exchanger from running dry and thus prevents falsification of the oil level in oil pan 14.

Figure 2:
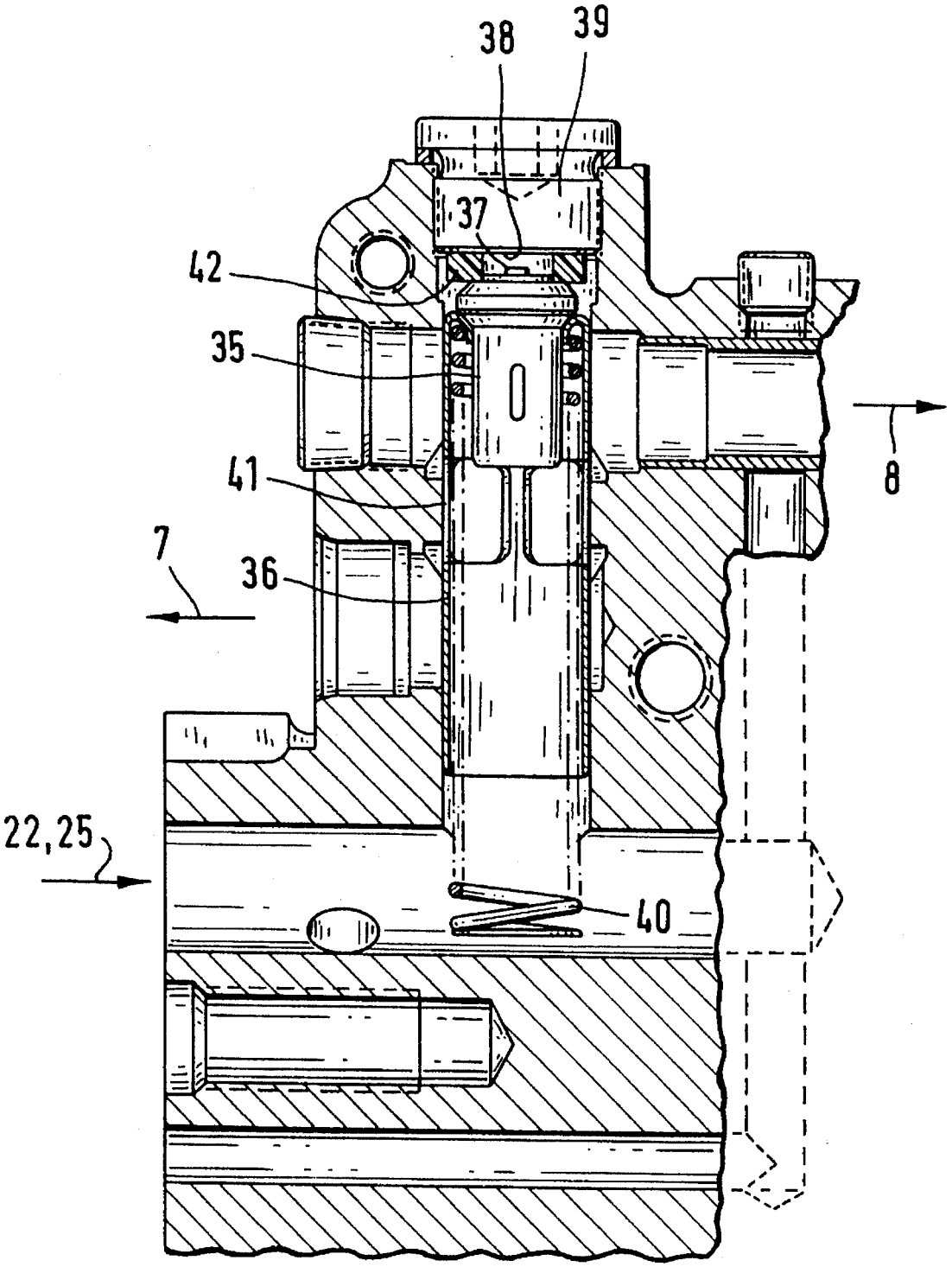
FIG. 2 shows a view of the oil circuit thermostat with an inserted fusible ring.

FIG. 2 shows the oil thermostat 6 inserted into a housing, the thermostat having a thermostat housing 35 and a valve body 36 attached thereto. The thermostat housing 35 normally is braced, via plunger 37, against a wall 38, which is formed by screw plug 39. In this way, the oil thermostat as a whole is biassed by a spring 40 in the direction of the wall 38. The oil from the cooling oil circuit coming through the individual cylinders and the individual cylinder heads passes, via the combined drain line 22 and the return flow line 25, into the valve body, flows through the latter, and passes via a control opening 41 into the valve body 36 and into the heat exchanger bypass line 8. By virtue of the fact, however, that a fusible ring 42 is arranged between the thermostat housing 35 and the wall 38 before first operation of the engine, the thermostat housing 35 and the valve body 36 inclusive of the control opening 41 are shifted outward by a certain amount from their rest position. By this means, the control opening 41 is open to the heat exchanger inlet line 7, at least in a partial cross section, so that oil can flow into the inlet line 7 even before the first operation of the internal combustion engine. In this way, it is insured that a cold internal combustion engine will be filled with the prescribed quantity of oil at its initial filling.

Figure 3:
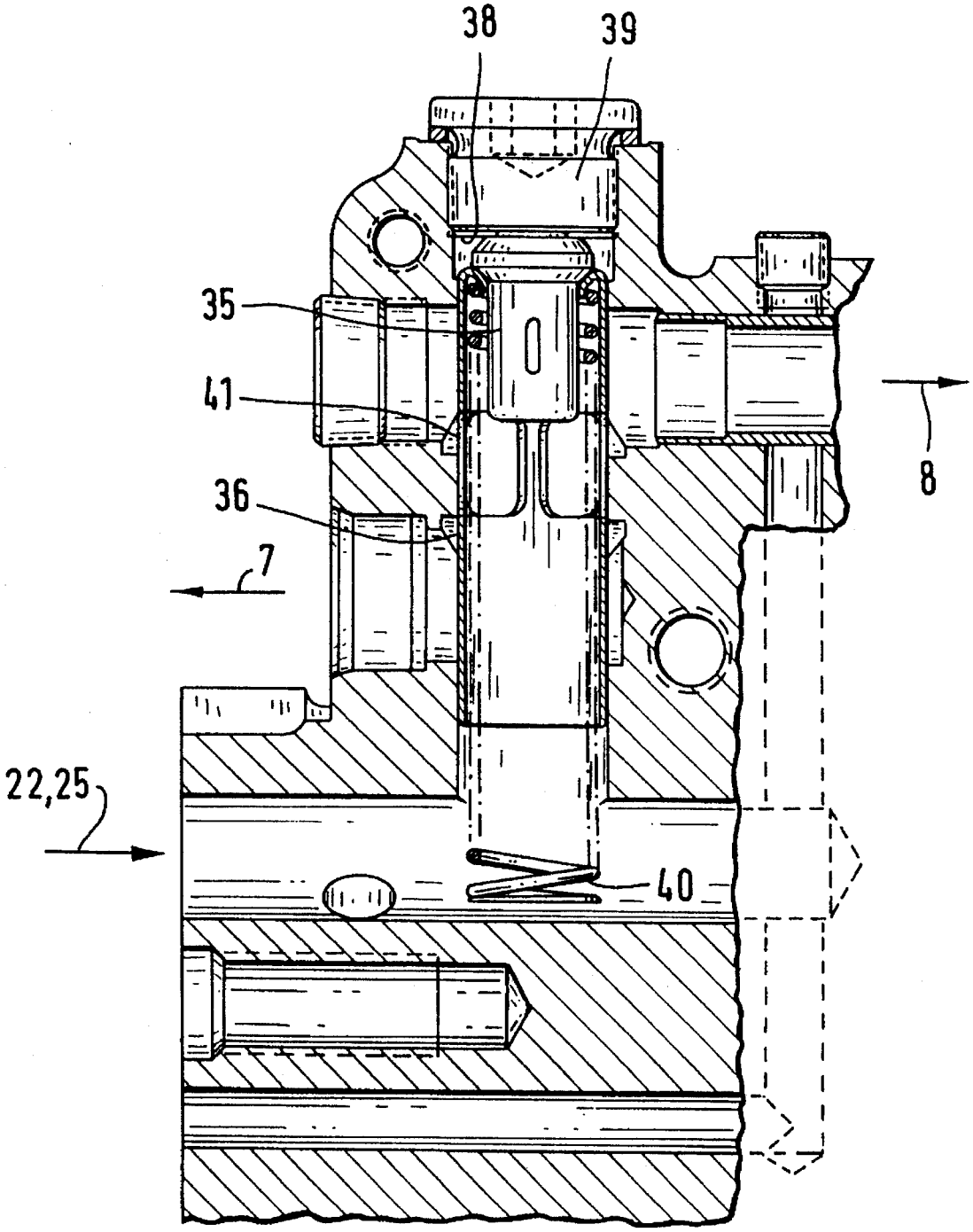
FIG. 3 shows a view of the thermostat after the fusible ring has melted away.

Upon the first operation of the internal combustion engine, the fusible ring 42 melts away with increasing heating of the internal combustion engine or of the oil, so that upon re-cooling of the oil or of the internal combustion engine, the thermostat housing 35 or plunger 37 comes into contact with the wall 38 and thus, in the cold condition, the entry of oil into heat exchanger inlet line 7 as shown in FIG. 3 is blocked.

That which is claimed:

1. In an internal combustion engine having a crankcase, with a of cylinders in in-line relationship with one another, a crankshaft supported in a said crankcase, a cylinder head for each cylinder, a piston in each cylinder, connecting rods interconnecting said pistons with said crankshaft and an engine lubrication system, the combination comprising:

a cylinder cooling space in each cylinder, a head cooling space in each cylinder head, means connecting said cylinder cooling spaces in series fluid communication, means connecting said head cooling spaces in series fluid communication, a source of lubricating oil, an oil pump connected in oil receiving relation to said source of lubricating oil, an inlet line interconnecting said pump and said cylinder cooling space of one end cylinder, a drain line (22) connected to said cylinder cooling space of the opposite end cylinder, a throttle (23) in said the drain line (22), a supply line (24) connecting said head cooling space of said opposite end cylinder to said drain line (22) at point upstream of said throttle (23) thereby placing said head cooling spaces in series fluid communication with said cylinder cooling spaces and a return flow line (25) connecting said head cooling space of said opposite end cylinder to said drain line (22) at a point downstream from said throttle (23).

2. The internal combustion engine of claim 1 wherein each of said head cooling spaces has an flow connection with said return flow line (25), by passage means including a web hole (21) and a connecting hole (29) branching therefrom.

3. The internal combustion engine of claim 1 wherein the oil flow direction through said head cooling spaces is opposite to the oil flow direction through said cylinder cooling spaces.

4. In an internal combustion engine having a crankcase with a plurality of cylinders, a crankshaft supported in said crankcase, a cylinder head for each cylinder, a piston in each cylinder, connecting rods interconnecting said pistons with said crankshaft and an engine lubrication system, the combination comprising:

a cylinder cooling space in each cylinder, a head cooling space in each cylinder head, means connecting said cylinder cooling spaces in series fluid communication, means connecting said head cooling spaces in series fluid communication, said cylinder cooling spaces and said head cooling spaces being connected in series fluid communication, a source of lubricating oil, an oil pump connected in oil receiving relation to said source of lubricating oil, an oil conveying passageway between said pump and one of said cylinder cooling spaces, rocker arms supported by rocker arm bearings in said cylinder heads and a return flow line connected to at least one cylinder head cooling space, said return flow line having an oil flow connection with each of said rocker arm bearings.

5. In an internal combustion engine having a crankcase with a plurality of cylinders, a crankshaft supported in said crankcase, a cylinder head for each cylinder, a piston in each cylinder, connecting rods interconnecting said pistons with said crankshaft and an engine lubrication system, the combination comprising;

a cylinder cooling space in each cylinder, a head cooling space in each cylinder head, means connecting said cylinder cooling spaces in series fluid communication, means connecting said head cooling spaces in series fluid communication, said cylinder cooling spaces and said head cooling spaces being connected in series fluid communication, a source of lubricating oil, an oil pump connected in oil receiving relation to said source of lubricating oil, an oil conveying passageway between said pump and one of said cylinder cooling spaces, an oil flow circuit between said cooling spaces and said lubrication system (2) including a heat exchange bypass line (8), an air/oil heat exchanger, a heat exchanger inlet line (7) connecting said air/oil heat exchanger in oil receiving relation to said oil flow circuit, a thermostat (6) in said oil flow circuit controlling flow of oil to said heat exchanger inlet line (7) and to said heat exchanger bypass line (8)

a heat exchanger return flow line (17) connected to said air/oil heat exchanger and an oil filter having a contaminated oil space (10) and a clean oil space (9), said contaminated oil space (10) being connected in oil receiving relation to said heat exchanger bypass line and to said heat exchanger return flow line (17), and said clean oil space (10) being connected in oil delivery relation to said lubrication system (2).

6. Internal combustion engine claim 5 wherein said engine includes at least one piston injection oil nozzle (28) for each cylinder, said piston injection oil nozzles (28) being connected in oil receiving relation to said lubrication system (2).

7. In an internal combustion engine having a crankcase, with plurality of cylinders, a crankshaft supported in said crankcase, a cylinder head for each cylinder, a piston in each cylinder, connecting rods interconnecting said pistons with said crankshaft and an engine lubrication system, the combination comprising:

a cylinder cooling space in each cylinder, a head cooling space in each cylinder head, means connecting said cylinder cooling spaces in series fluid communication, means connecting said head cooling spaces in series fluid communication, said cylinder cooling spaces and said head cooling spaces being in connected series fluid communication, an engine oil pan for lubricating oil, an oil pump connected in oil receiving relation to said oil pan, an oil conveying passageway between said pump and one of said cylinder cooling spaces, an oil filter connected in clean oil delivery relation to said lubrication system (2), a bypass line interconnecting said cooling spaces and said oil filter, a discharge line connected to said bypass line upstream of said oil filter for discharging oil to said oil pan and a pressure control valve in said discharge line, said pressure control valve discharging oil toward said oil pan.

8. The internal combustion engine claim 7 and further comprising a heating supply line connected in oil receiving relation to said discharge line downstream of said pressure control valve, a heating return line connected in oil delivery relation to said discharge line downstream of said pressure control valve, a heating pressure valve opening toward the oil pan positioned in said discharge line between the connections of said heating supply line and heating return line with said discharge line and an anti-draining valve in said heating return line; said anti-draining valve discharging valve oil in the direction toward said discharge line.

9. The internal combustion engine claim 8 wherein the sum of the opening pressures of pressure control valve and heating pressure valve is at least 3 bar and the opening pressure of the anti-draining valve is approximately 0.3 bar.

10. In an internal combustion engine having a crankcase with plurality of cylinders, a crankshaft supported in a said crankcase, a cylinder head for each cylinder, a piston in each cylinder, connecting rods interconnecting said pistons with said crankshaft and an engine lubrication system, the combination comprising;

a cylinder cooling space in each cylinder, a head cooling space in each cylinder head, means connecting said cylinder cooling spaces in series fluid communication, means connecting said head cooling spaces in series fluid communication, said cylinder cooling spaces and said head cooling spaces being connected in series fluid communication, a source of lubricating oil an oil pump connected in oil receiving relation to said source of lubricating oil, an oil conveying passageway between said pump and one of said cylinder cooling spaces, an oil flow circuit between said cooling spaces and said lubrication system, a thermostat in said oil flow circuit having a wall and a thermostat housing shiftable relative to said wall between open and closed positions, a plunger on said thermostat housing abutting said wall, a spring biasing said thermostat housing toward said wall, an air/oil heat exchanger connected in oil receiving relation to said thermostat, a fusible body between said thermostat housing and said wall preventing shifting of said thermostat housing to its closed position, said fusible body melting upon said engine being operated to bring said lubricating oil to a predetermined temperature.

11. The internal combustion engine of claim 10 wherein said fusible body is a fusible ring (42).

12. The internal combustion engine of claim 10 wherein said fusible body is fabricated from a wax.

* * * * *